US005813588A

United States Patent [19]

Lin

[11] Patent Number: 5,813,588

[45] Date of Patent: Sep. 29, 1998

[54] MAGAZINE ASSEMBLY FOR FASTENER DRIVING TOOLS

[76] Inventor: George Lin, P.O. Box 10780, Taipei, Taiwan

[21] Appl. No.: 959,178

[22] Filed: Oct. 28, 1997

[30] Foreign Application Priority Data

Oct. 9, 1996 [TW] Taiwan ..... 85112383

[51] Int. Cl.[6] ..... B25C 5/16; B25C 1/04

[52] U.S. Cl. ..... 227/109; 227/120

[58] Field of Search ..... 227/109, 120, 227/130, 136

[56] References Cited

U.S. PATENT DOCUMENTS

| | | | |
|---|---|---|---|
| 4,463,888 | 8/1984 | Geist et al. | 227/109 |
| 4,524,896 | 6/1985 | Morrell, Jr. | 227/109 |
| 4,815,647 | 3/1989 | Chou | 227/109 |
| 5,180,091 | 1/1993 | Ota | 227/120 |
| 5,433,367 | 7/1995 | Liu | 227/120 |
| 5,588,577 | 12/1996 | Chen | 227/109 |

*Primary Examiner*—Scott A. Smith
*Attorney, Agent, or Firm*—Pollock, Vande Sande & Priddy

[57] ABSTRACT

A magazine assembly for fastener driving tools includes a longitudinal track element having a J-shaped section for supporting the fasteners which are fed one by one towards a driver track of the nose of the fastener driving tool. There is provided a longitudinal guide plate having a lateral end mounted on the track element and a front end inserted into the nose. The guide plate is parallel to a slide groove of the track element which is for the sliding of the fastener tips and is located above the slide groove so as to restrict the upper edges and outer edges of the head portions of the fasteners. The height of the position of the guide plate to be mounted onto the track element may be adjusted to suit fasteners of various lengths.

18 Claims, 6 Drawing Sheets

MAGAZINE ASSEMBLY FOR FASTENER DRIVING TOOLS

RELATED APPLICATIONS

The applicant claims the benefit of the filing date of provisional application Ser. No. 08/745,420 filed on Nov. 12, 1996, under 35 USC 119 (e)(1).

BACKGROUND OF THE INVENTION

1. Field of the Invention

The present invention relates generally to a magazine assembly, and more particularly to a magazine assembly for pneumatic fastener driving tools.

2. Description of the Prior Art

Magazine assemblies for supporting rows of fasteners may be mounted on all kinds of fastener driving tools and have wide applications. For a pneumatic fastener driving tool used in carpentry, for instance, a pneumatic valve is provided to control a drive element to drive a driver blade to push each nail entering a nose of the driving tool to move along a driver track into a workpiece.

The main structure of the pneumatic fastener driving tool includes, as is well known to those skilled in the art, a tool body and a drive element mounted above a front portion of the tool body. A nose consisting of two nose elements for defining a driver track in its interior is also provided. The driver blade in the drive element above the nose may reciprocate in the driver track. A large portion of the tool body forms a handle for gripping purpose. A rear portion of the tool body has secured thereon a support portion of a magazine assembly. The magazine assembly includes a longitudinal track element having a front end mounted on the nose for supporting a row of fasteners in the track element and which are fed one by one into the driver track of the nose to be struck out.

In the prior art, in order to enable the fasteners to slide along the track of the magazine assembly and prevent the fasteners from freely leaping out of the track, two side portions are provided to define the track and limiting the sides of the shanks of the fasteners; as disclose in U.S. Pat. No. 5,433,367, the head portions of the fasteners are suspended by the guide plate 20 and an abutment plate 30.

U.S. Pat. Nos. 2,979,725, 3,060,439, 4,174,802 and 4,688,710 all provide similarly a track formed by a lateral side and a longitudinal cover for accommodating linear fasteners. In addition, U.S. Pat. No. 2,733,440 teaches a track for U-shaped fasteners defined by two lateral upright sides. German Patent No. 2,757,698, on the other hand, discloses a track defined by two lateral upright sides in a U-shaped base cover for accommodating linear fasteners. The mode of assembly of the magazine assembly and the nose of the driving tool generally falls into two types. One is they are perpendicular to each other. The other is the magazine assembly slants downwardly with respect to the nose. In this way, it is not necessary to provide a spring to push the fasteners to slidably displace along the track. There are two ways of supporting the linear fasteners in the track. In the first, a recess along the length of the track is provided to suspendably receive the head portions of the fasteners. In the second, a U-shaped track is provided for supporting the tips of the fasteners.

According to the prior art, two opposite upright sides must be provided to support the shanks of the fasteners, and it is necessary to support the head portions of the tips of the fasteners. Furthermore, it is believed that two lateral sides must be provided in order to define a tunnel-like track for the displacement of the shanks no matter what kinds of fasteners are used. The magazine assembly disclosed in U.S. Pat. No. 4,304,349 should be deemed to have the simplest structure. The disclosed magazine assembly comprises a J-shaped magazine body and a long strip-like lateral cover. The lateral cover and the magazine body may displace relative to each other to open the magazine assembly for the filling of fasteners from the side into the magazine body. A locking means is further provided for locking the magazine body and the lateral cover. Although the design in U.S. Pat. No. 4,304,349 uses the least components of all the prior art, it still employs a lateral cover to define a track with the magazine body. It can therefore be seen that the conventional technical concept has become so deep-rooted that almost every one in the art believes that, with the existing techniques, it is impossible to provide an open magazine body for supporting the fasteners.

With the conventional design, it is impossible to simplify the components or reduce the weight of the magazine assembly. For experienced users, even if the total weight of the driving tool may be reduced by only 0.1 kg, it will still be helpful to them in prolonged operations. Aside from reducing fatigue, it will prevent unsafe actions caused by fatigue. Additionally, it may facilitate operation.

Furthermore, according to the conventional technical concept, it is believed that for the displacement of U-shaped fasteners in the magazine, it is necessary to provide a strip-like saddle portion as a means of support, such as the device disclosed in U.S. Pat. No. 2,733,440. But when a U-shaped fastener is being struck and is pulled apart from its adjacent fastener, there may be wavering or vibration so that the fasteners deflect, causing jamming in the driver track. Improvements thereon are therefore necessary.

SUMMARY OF THE INVENTION

Accordingly, a primary object of the present invention is to provide a magazine assembly in which only a single open magazine body forms a track element and a small guide plate and there is no need for any lateral cover.

Another object of the present invention is to provide a magazine assembly for suppressing the fasteners inside the magazine assembly to prevent the front ends of the fasteners from jumping upwardly during striking, the magazine assembly being suited for use with all kinds and lengths of fasteners.

A further object of the present invention is to provide a magazine assembly which is simplified in construction, lighter, and easier to be operated and repaired.

Still another object of the present invention is to provide a magazine assembly having an elastic element for suppressing the shanks of the fasteners.

In order to achieve the above-mentioned objects, the magazine assembly according to the present invention essentially comprises a magazine body with an open lateral side and having a fastener supporting portion and a side portion. A front end of the magazine body is inserted into a nose of a fastener driving tool such that the supporting portion may hold the tips of the fasteners and carry the fasteners into the nose for striking. There is provided a guide plate which may be adjustably secured at the side portion of the magazine body to be parallel with the slide groove for restricting the head portions of the fasteners.

In some of the embodiments to be described hereinafter, the magazine assembly for fastener driving tools according to the present invention has a longitudinal track element of a J-shaped section for supporting the tips of the fasteners, and a longitudinal guide plate having a lateral end mounted on the track element with a front end thereof inserted into a guide track of a nose of the driving tool. The guide plate runs parallel to the slide groove for restricting the head portions of the fasteners, and the position of the guide plate is adjustable to suit fasteners of different lengths. The inner side of the fastener tips lie against the side portion of the track while the other side of the fastener tips are restricted by the ledge of the guide plate. The nose may be inlayed with magnets to attract the guide plate so that the guide plate will not be loose easily.

According to the magazine assembly of the present invention, the track element may be widened to contain U-shaped fasteners. As the upper ends of the U-shaped fasteners are restricted by the guide plate above from freely jumping upwardly during striking and the tips of the fasteners are supported on the slide groove, there is no need to provide a strip-like saddle portion for mounting of the U-shaped fasteners. The filling of U-shaped fasteners into the magazine assembly may thus be simplified and made easy.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
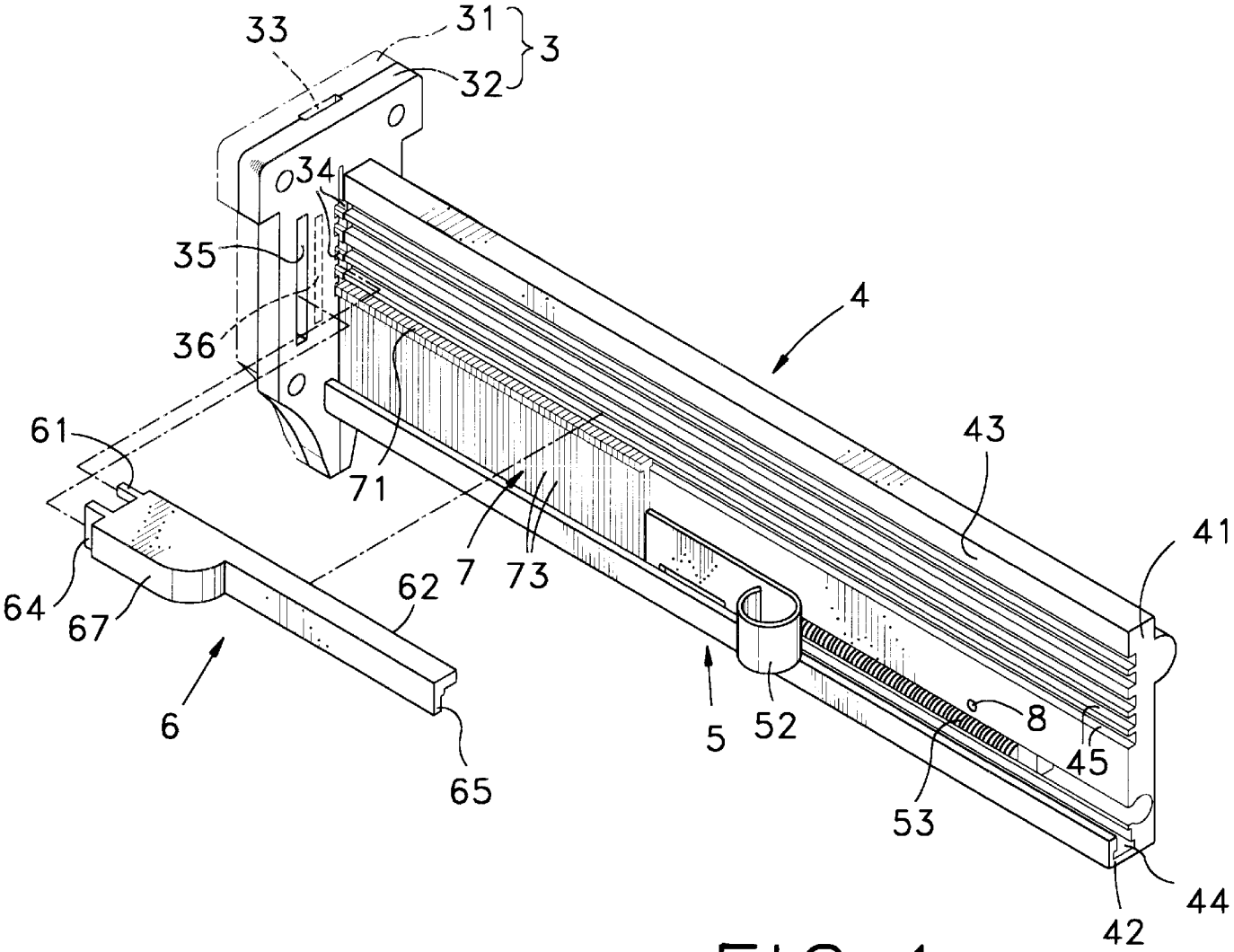
FIG. 1 is an elevational view of the magazine assembly of the present invention in which a guide plate is shown in an exploded state.
Figure 2:
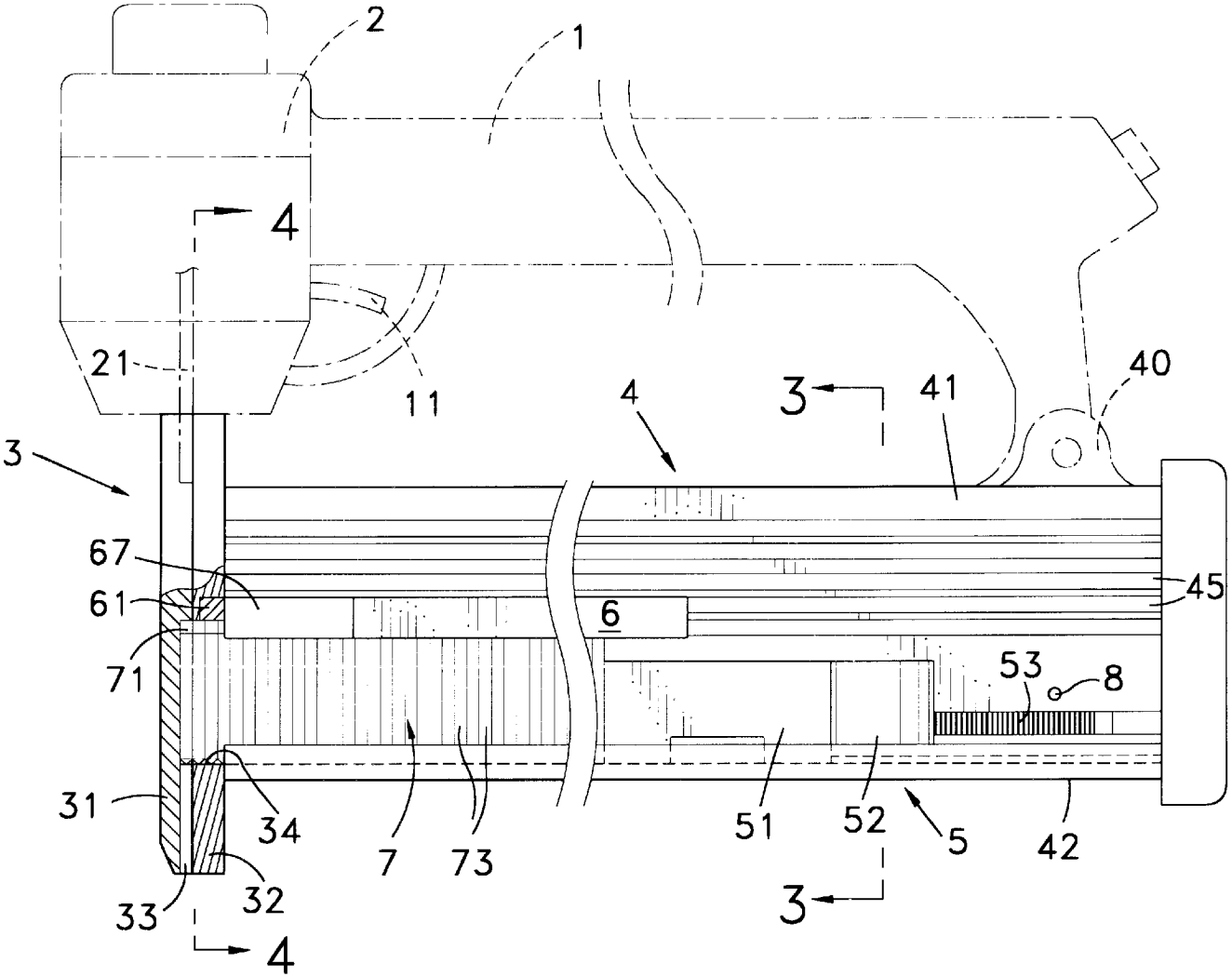
FIG. 2 is a front view of the magazine assembly of the present invention.

With reference to FIGS. 1 and 2, the fastener driving tool according to the present invention essentially comprises a tool body 1 having a large portion thereof forming a hollow handle, a drive element 2 mounted at a front end of the tool body 1. High-pressure gas enters from a rear end of the tool body 1 via a hollow interior in the center of the body 1 into the drive element 2. The drive element 2 accommodates therein a pneumatic pressure valve controlled by a trigger 11 and has a driver blade 21 driven by the pressure valve such that it may displace upwardly and downwardly in a nose portion 3 mounted below the drive element 2.

Figure 4B:
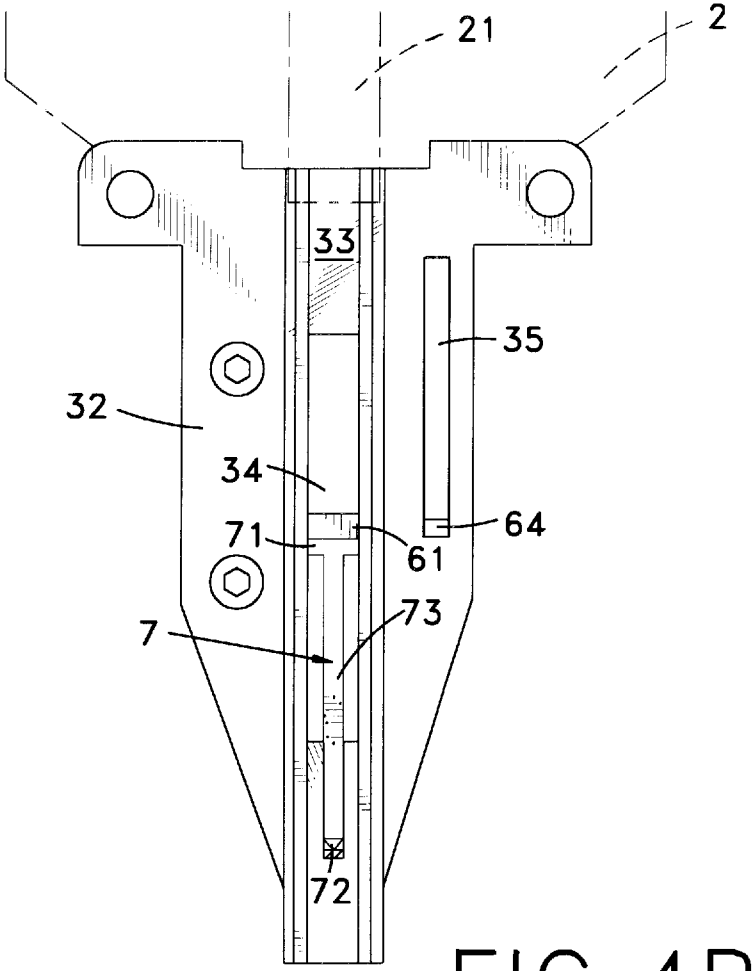
FIG. 4B is similar to FIG. 4A but showing another preferred embodiment.

The nose 3 has a first nose element 31 and a second nose element 32 for allowing the driver blade 21 to reciprocate in a driver track 33 defined by the first and second nose elements 31, 32 when they are aligned. The second nose element 32 has a track element 41 of a magazine assembly 4 locked thereonto and is provided with a longitudinal fastener guide track 34 as shown in the sectional view in FIGS. 4A and 4B. The magazine assembly 4 is provided with a support portion 40 located at its rear half portion and fixedly secured to the tool body 1. The magazine assembly 4 is provided for carrying a row of fasteners 7 each of which passes through the guide track 34 of the second nose element 32 into the driver track 33 to get ready for being struck out of the nose portion 3.

Figure 3:
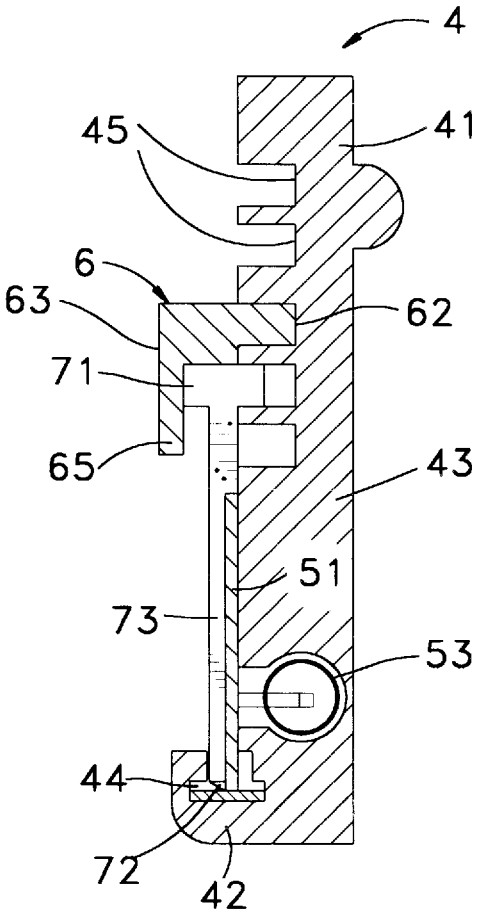
FIG. 3 is a sectional view taken along line 3—3 of FIG. 2.

The magazine assembly 4 of the present invention comprises the above-mentioned track element 41 having a front end mounted at the nose portion 3. A section of the track element 41 is shown in FIG. 3. The track element 41 has an interior forming a base 42 of a slide groove 44 for supporting the tips 72 of the fasteners 7 such that they may freely slide therealong. The track element 41 further has a side portion 43 for supporting the shanks 73 of the fasteners 7 in the slide groove 44.

In addition to the track element 41, the magazine assembly 4 of the invention has a longitudinal guide plate 6 having a front end 61, an inner lateral end 62 and an outer lateral end 65. The inner lateral end 62 is attached freely at the side portion 43 of the track element 41. The front end 61 is inserted into the guide track 34 of the second nose element 32, as shown in FIG. 2, such that it is contiguous to the driver track 33. The front end 61 and the inner lateral end 62 together secure the guide plate 6 in place to be parallel to the slide groove 44 so that the head portions 71 of the fasteners 7 may be restrained, and the outer lateral end 63 is provided with a ledged pendant 65.

With reference to FIGS. 1 and 2, a fastener pusher device 5 is arranged on the magazine assembly 4 and has a push plate 51 provided with a protrusive exerting portion 52. The push plate 51 is forced by an elastic element 53, for example a tensile spring, to push the last one of the fasteners 7 in the slide groove 44, as shown in FIG. 1, so that the fasteners 7 may advance towards the nose portion 3.

Figure 6:
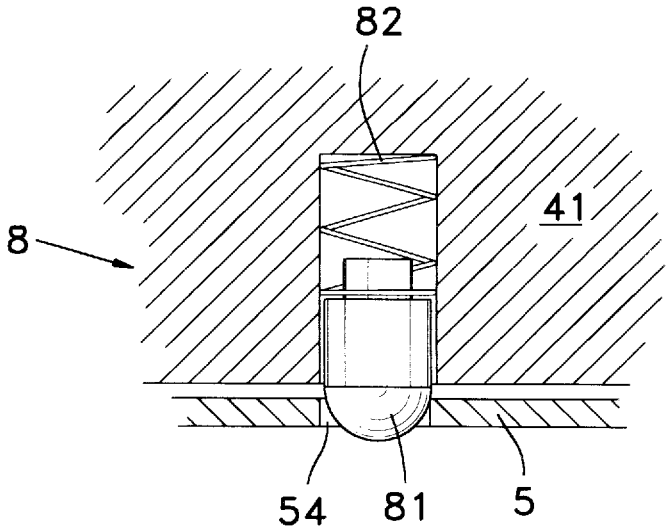
FIG. 6 is a top sectional view of the positioning means of the magazine assembly of the present invention.

Furthermore, referring to the example shown in FIG. 6 the track element 41 is provided with a positioning means 8 at a rear end thereof. The positioning means 8 has a stop element 81 capable of reciprocating actions for temporarily engaging a hole 54 or a shallow recess of the pusher device 5. The stop element 81 may be provided onto the pusher device 5, the hole 54 will relatively be provided on the track element 41. Nevertheless, this is not to be made easily. The stop element 81 is partially protuded frequently into the hole 54 by the function of a spring 82 to hold the pusher device 5 in place temporarily. The function of the positioning device 8 is to temporarily hold the pusher device 5 in place on the track element 41 so as to facilitate the filling of fasteners from the side of the magazine assembly 4. As the filling is done, the front end of the stop element 81 is to be pressed to allow the moving of the pusher device 5.

The second nose element 32 of the nose 3 is provided with a plurality of longitudinally arranged slots 35, as the preferred embodiment shown in FIG. 1, and the guide plate 6 is provided with a protrudent end 67. The protrudent end 67 has a front projection 64 to be engaged into the slot 35 of the second nose element 32. When the guide plate 6 is assembled to the track element 41, the protrudent end 67 is abutting the guide track 34 of the second nose element 32, as shown in FIG. 2, so that the depth that the front end 61 of the guide plate 6 inserted into the guide track 34 may not be greater than the thickness of the second nose element 32. The second nose element 32 may conceal a magnet 36 for attracting the protrudent end 67 of the guide plate 6. In this way, the guide plate 6 is assembled to the track element 41 by engaging a selected positioning groove 45 of the side portion 43 and a selected slot 35 of the second nose element 32, and is then pushed towards the nose portion 3 so that the front end 61 of the guide plate 6 is inserted into the guide track 34. At this point, the front projection 64 of the guide plate 6 is also inserted into the slot 35 so that the guide plate 6 may be secured very firmly. If the magnet 36 is also provided in the second nose element 32, the guide plate 6 may be secured even more firmly.

Figure 4A:
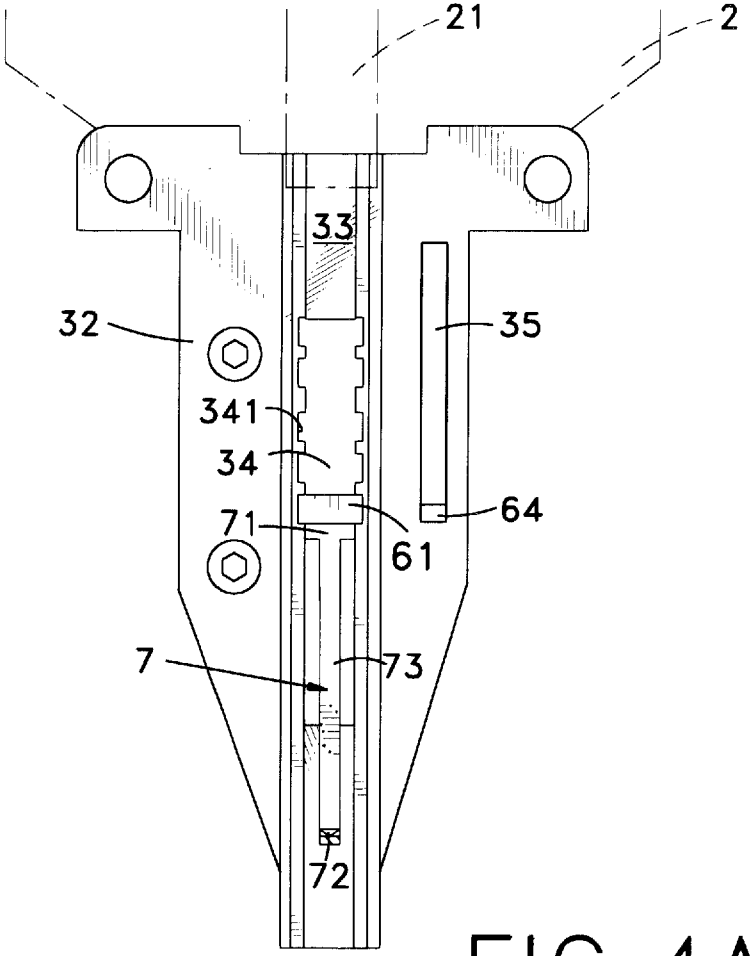
FIG. 4A is a sectional view taken along line 4—4 of FIG. 2.

The guide track 34, as shown in FIG. 4A, may be a planar longitudinal track for the insertion of the front end 61 of the guide plate 6. It may also be configured to have two symmetrical rack-like sides having a plurality of spaced indentations 341. The front end 61 of the guide plate 6 may selectively engage into any one of the indentations 341. The latter design may provide the front end 61 of the guide plate 6 with a good support so that it may not easily bend or flex, and the guide plate 6 may be firmly secured in the magazine assembly 4 even without the front projection 64.

The shape of the slide groove 44 of the track element 41 may be modified to suit fasteners of various types. If U-shaped fasteners are used in the driving tool of the invention, since their upper ends may be limited by the guide plate 6 so that their tips slide along the slide groove 44, there is no need to utilize a saddle portion as in the prior art; this is a significant breakthrough in the art. Furthermore, the guide plate 6 has a pendant 65 at its outer side for limiting the outer sides of the head portions 71 of the fasteners 7 and keeping the fasteners 7 from falling off easily.

Figure 5:
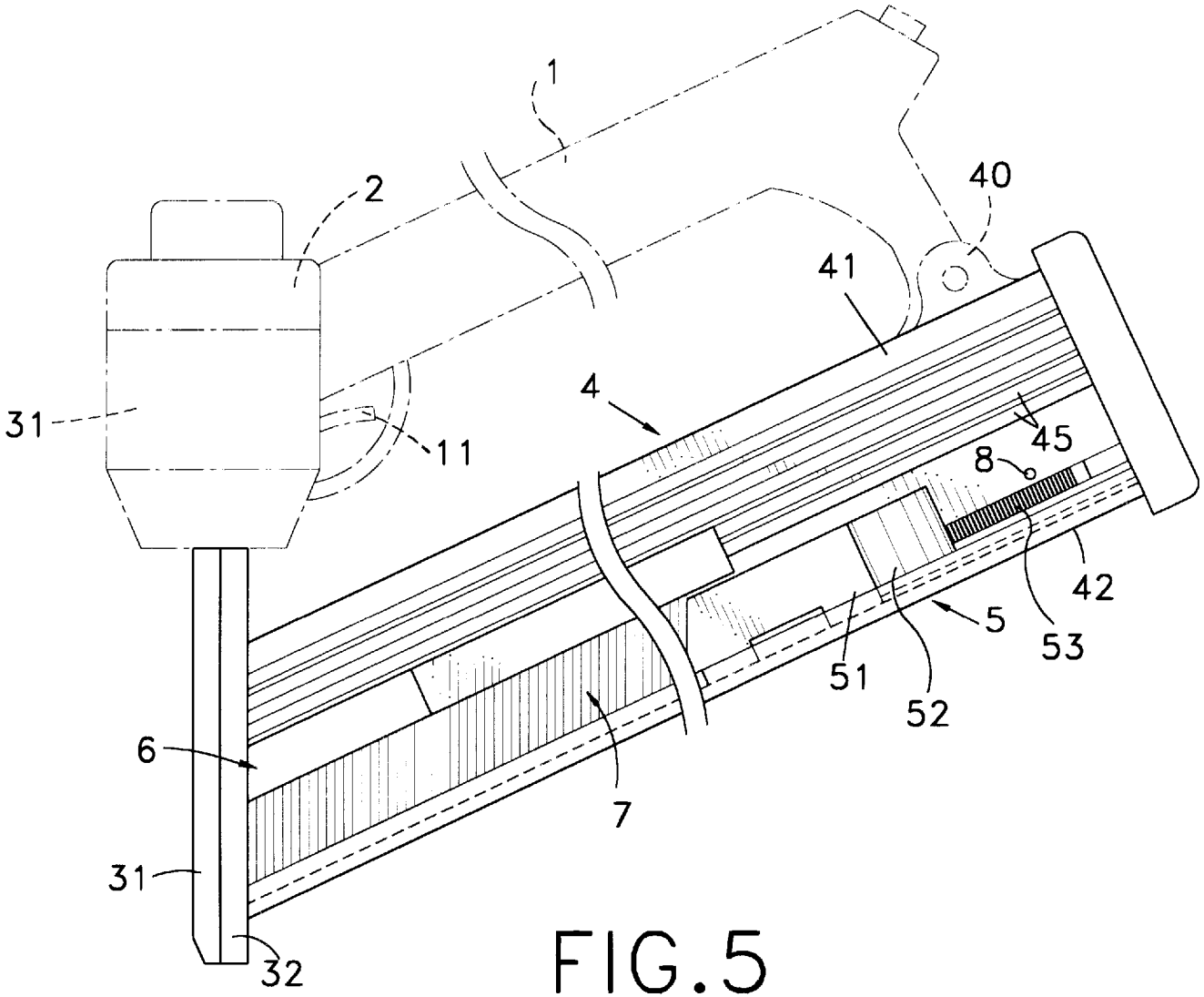
FIG. 5 is similar to FIG. 2 but showing the embodiment of an inclined magazine assembly.

According to the magazine assembly 4 of the present invention, the track element 41 may be assembled to the nose 3 such that it is perpendicular thereto, as shown in FIG. 2. Or as shown in FIG. 5, the track element 41 may be mounted slantingly to the nose 3. Either way may achieve the intended objects and effects. The magazine assembly 4 does not require an outer cover so that the structure of the driving tool of the invention may be simplified and the driving tool conveniently operated.

Although the present invention has been illustrated and described with reference to the preferred embodiments thereof, it should be understood that it is in no way limited to the details of such embodiments, but is capable of numerous modifications within the scope of the appended claims.

What is claimed is:

1. A fastener driving tool for driving fasteners into a workpiece, said fastener driving tool comprising:

a tool body;

a drive element assembled to said tool body and having a driver blade;

a nose having a first nose element and a second nose element for allowing said driver blade to reciprocate along a driver track defined by said first nose element and said second nose element when said first nose element and said second nose element are aligned; said nose supporting said drive element, and said second nose element being provided with a guide track which is longitudinal in section;

a magazine assembly having a support portion secured to said tool body, said magazine assembly supporting a row of fasteners which pass along said guide track of said second nose element and are fed one by one into said driver track; said fasteners are defined by three parts which are tips, shanks, and head portions; said magazine assembly comprising a longitudinal track element mounted at said nose by a front end and having a base in section, with an interior thereof defining a slide groove, for supporting said tips of said fasteners to freely slide along said slide groove, and a side portion for supporting said shanks of said fasteners in said slide groove; a longitudinal guide plate having a front end, an outer lateral end, and an inner lateral end, said inner lateral end being mounted to said side portion of said track element, said outer lateral end being provided with a pendant for restricting outer edges of said head portions of the fasteners, and said front end of said guide plate being inserted into said guide track of said second nose element and contiguous to said driver track to secure said guide plate in place along with said inner lateral end, such that said guide plate may run parallel to said slide groove; and a fastener pusher device having a push plate forced by an elastic element to move along said slide groove and push said fasteners to advance towards said nose.

2. A fastener driving tool as claimed in claim 1, wherein said magazine assembly further comprising a positioning device fixedly provided at a rear end of said track element and having a stop element capable of reciprocating actions for temporarily retaining said fastener pusher device so as to facilitate filling of fasteners in said slide groove.

3. A fastener driving tool as claimed in claim 1, wherein said track element of said magazine assembly is mounted to said nose such that it is perpendicular or oblique with respect thereto.

4. A fastener driving tool as claimed in claim 1, wherein said side portion of said track element has a plurality of parallel positioning grooves, and said inner lateral end of said guide plate may selectively engage into any one of said positioning grooves so as to suit fasteners of various lengths.

5. A fastener driving tool as claimed in claim 1, wherein said guide plate has a protrudent end adjacent to said front end thereof, said protrudent end leaning against an outer side of said guide track of said second nose element such that the depth that said front end of said guide plate inserted in said guide track is not greater than the thickness of said second nose element.

6. A fastener driving tool as claimed in claim 1, wherein said second nose element of said nose has a longitudinally arranged slot, and said guide plate has a protrudent end having a front projection at a front edge thereof to be inserted into said slot of said second nose element.

7. A fastener driving tool as claimed in claim 1, wherein said second nose element of said nose has a magnet to attract said guide plate and prevent said guide plate from falling off easily from said track element.

8. A fastener driving tool as claimed in claim 1, wherein said guide track of said second nose element is a planar longitudinal track.

9. A fastener driving tool as claimed in claim 1, wherein said guide track of said second nose element has two symmetrical rack-like sides with a plurality of spaced indentations for said front end of said guide plate to selectively insert into any one of said indentations.

10. A magazine assembly mounted to a fastener driving tool for supporting a row of fasteners, defined by three parts which are tips, shanks, and head portions, to be pushed along a guide track of a nose of said fastener driving tool and then into a driver track of said fastener driving tool; said nose being provided with a first nose element and a second nose element; said magazine assembly comprising:

a longitudinal track element having a base with a slide groove in section for supporting said tips of said fasteners which may freely slide therein, and a side portion for supporting said shanks of said fasteners in said slide groove;

a longitudinal guide plate having an inner lateral end, an outer lateral end, and a front end, said inner lateral end being mounted at said side portion of said track element, said outer lateral end having a pendant for restricting an outer edge of said head portions of said fasteners, and said front end of said guide plate being inserted into said guide track in a contiguous relationship with said driver track and being mounted at said nose of said fastener driving tool such that said guide plate may be firmly secured and run parallel to said slide groove for restricting said head portions of said fasteners; and a fastener pusher device being able to move along said slide groove and push said fasteners towards said nose.

11. A magazine assembly as claimed in claim 10, wherein said magazine assembly further comprising a positioning device fixedly provided at a rear end of said track element and having a stop element capable of reciprocating actions for temporarily retaining said fastener pusher device so as to facilitate filling of fasteners in said slide groove.

12. A magazine assembly as claimed in claim 10, wherein said track element of said magazine assembly is mounted to said nose such that it is perpendicular or oblique with respect thereto.

13. A magazine assembly as claimed in claim 10, wherein said side portion of said track element has a plurality of parallel positioning grooves, and said inner lateral end of said guide plate may selectively engage into any one of said positioning grooves so as to suit fasteners of various lengths.

14. A magazine assembly as claimed in claim 10, wherein said guide plate has a protrudent end adjacent to said front end of said guide plate thereof, said protrudent end leaning against an outer side of said guide track of said second nose element such that the depth that said front end of said guide plate inserted in said guide track is not greater than the thickness of said second nose element.

15. A magazine assembly as claimed in claim 10, wherein said second nose element of said nose has a longitudinally arranged slot, and said guide plate has a protrudent end having a front projection at a front edge thereof to be inserted into said slot of said second nose element.

16. A magazine assembly as claimed in claim 10, wherein said second nose element of said nose has a magnet to attract said guide plate and prevent said guide plate from falling off easily from said track element.

17. A magazine assembly as claimed in claim 10, wherein said guide track of said second nose element is a planar longitudinal track.

18. A magazine assembly as claimed in claim 10, wherein said guide track of said second nose element has two symmetrical rack-like sides with a plurality of spaced indentations for said front end of said guide plate to selectively insert into any one of said indentations.

* * * * *